US012721495B2

(12) United States Patent
Mandapaka

(10) Patent No.: US 12,721,495 B2
(45) Date of Patent: Sep. 1, 2026

(54) DISH CLEANING SYSTEM

(71) Applicant: Narasimha Mandapaka, Richmond, TX (US)

(72) Inventor: Narasimha Mandapaka, Richmond, TX (US)

( * ) Notice: Subject to any disclaimer, the term of this patent is extended or adjusted under 35 U.S.C. 154(b) by 134 days.

(21) Appl. No.: 18/747,598

(22) Filed: Jun. 19, 2024

(65) Prior Publication Data

US 2025/0387000 A1 Dec. 25, 2025

(51) Int. Cl.
*A47L 15/24* (2006.01)
*A47L 15/42* (2006.01)
*A47L 15/48* (2006.01)

(52) U.S. Cl.
CPC ..... *A47L 15/248* (2013.01); *A47L 15/241* (2013.01); *A47L 15/246* (2013.01); *A47L 15/4214* (2013.01); *A47L 15/4251* (2013.01); *A47L 15/486* (2013.01)

(58) Field of Classification Search
CPC .... A47L 15/248; A47L 15/241; A47L 15/246; A47L 15/4214; A47L 15/4251; A47L 15/486
USPC ..... 134/68
See application file for complete search history.

(56) References Cited

U.S. PATENT DOCUMENTS

| | | | | |
|---|---|---|---|---|
| 3,014,488 | A | 12/1961 | Seaman | |
| 5,259,889 | A | 11/1993 | Payzant | |
| 6,582,654 | B1 * | 6/2003 | Kral | A61B 1/125 134/171 |
| D813,359 | S | 3/2018 | Corbetta | |
| 10,835,098 | B2 | 11/2020 | Disch | |
| 11,019,980 | B2 | 6/2021 | Disch | |
| D972,795 | S | 12/2022 | Kim | |
| 2018/0213999 | A1 * | 8/2018 | Disch | A47L 15/241 |
| 2022/0248934 | A1 | 8/2022 | Welling | |
| 2022/0313054 | A1 | 10/2022 | Disch | |

FOREIGN PATENT DOCUMENTS

| | | | | |
|---|---|---|---|---|
| CN | 112826405 A | * | 5/2021 | A47L 15/4202 |
| KR | 20200115013 A | * | 10/2020 | A47L 15/4234 |
| WO | WO2021011604 | | 1/2021 | |

OTHER PUBLICATIONS

KR20200115013A—machine translation (Year: 2020).*
CN112826405A—machine translation (Year: 2021).*

* cited by examiner

*Primary Examiner* — Tinsae B Ayalew

(57) ABSTRACT

A dish cleaning system for washing and automatically storing dishes includes a cabinet which defines an interior volume therein. The interior volume includes a loading space, a washing space, a drying space, and a storage space. A dish rack is positionable in the cabinet and is configured to hold a plurality of dishes. He drives system is mounted in the cabinet and is configured to move the dish rack between the loading space, the washing space, the drying space and the storage space. A washing assembly is provided which is configured to wash contents of the washing space of the interior volume of the cabinet.

16 Claims, 7 Drawing Sheets

DISH CLEANING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

(1) Field of the Invention

The disclosure relates to dish washers and more particularly pertains to a new dish washer for washing and automatically storing dishes.

(2) Description of Related Art Including Information Disclosed Under 37 CFR 1.97 and 1.98

The prior art relates to various dish washers. It is known to the art that conveyor belts or other handling devices may be used to move a dish rack through a washing assembly. However, the prior art fails to disclose a dish washing system which includes separate enclosed spaces to load, wash, dry, and store dishes. Such a device may be advantageous in condensing cabinet space and automating storage of dishes after dishes are cleaned.

BRIEF SUMMARY OF THE INVENTION

An embodiment of the disclosure meets the needs presented above by generally comprising a cabinet which defines an interior volume therein. The interior volume includes a loading space, a washing space, a drying space, and a storage space. A dish rack is positionable in the cabinet and is configured to hold a plurality of dishes. He drives system is mounted in the cabinet and is configured to move the dish rack between the loading space, the washing space, the drying space and the storage space. A washing assembly is provided which is configured to wash contents of the washing space of the interior volume of the cabinet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
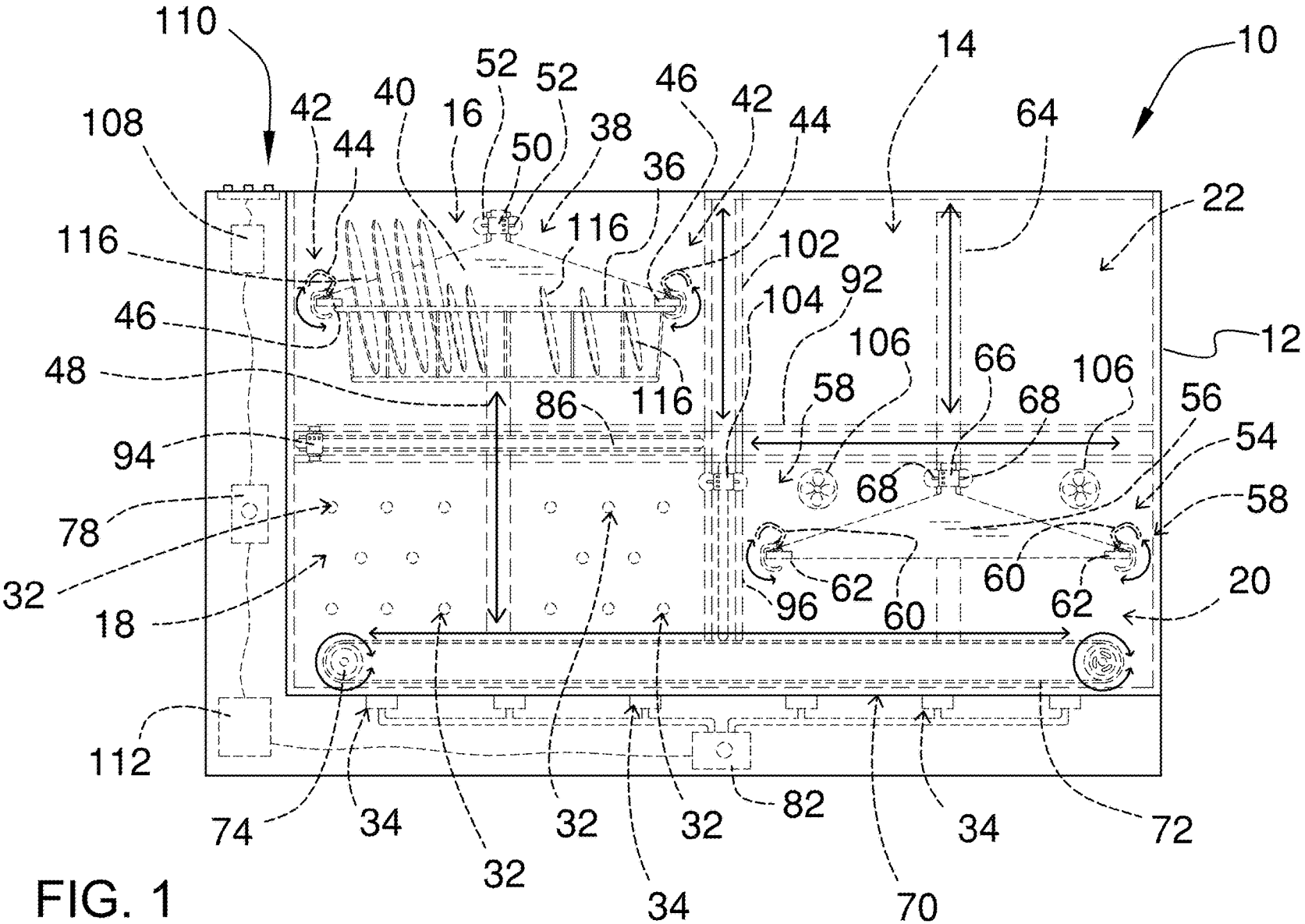
FIG. 1 is a front view of a dish cleaning system according to an embodiment of the disclosure.
Figure 3:
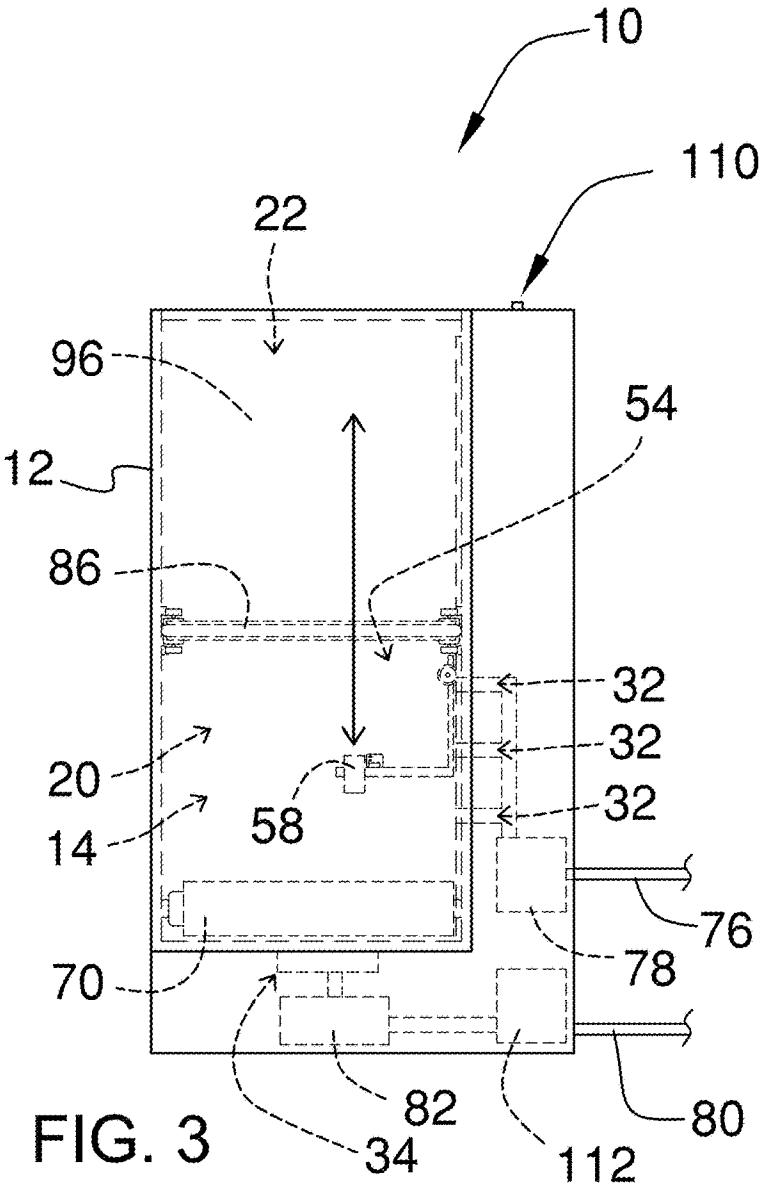
FIG. 3 is a second side view of an embodiment of the disclosure.
Figure 2:
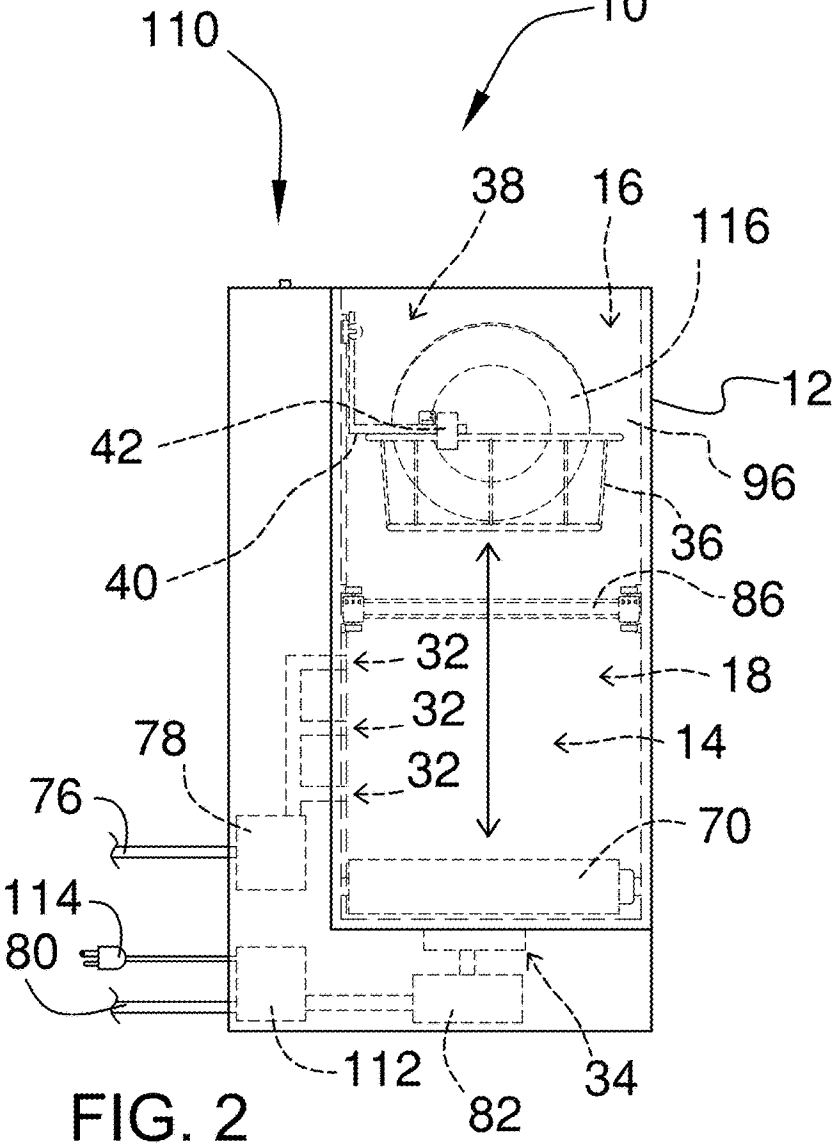
FIG. 2 is a first side view of an embodiment of the disclosure.
Figure 4:
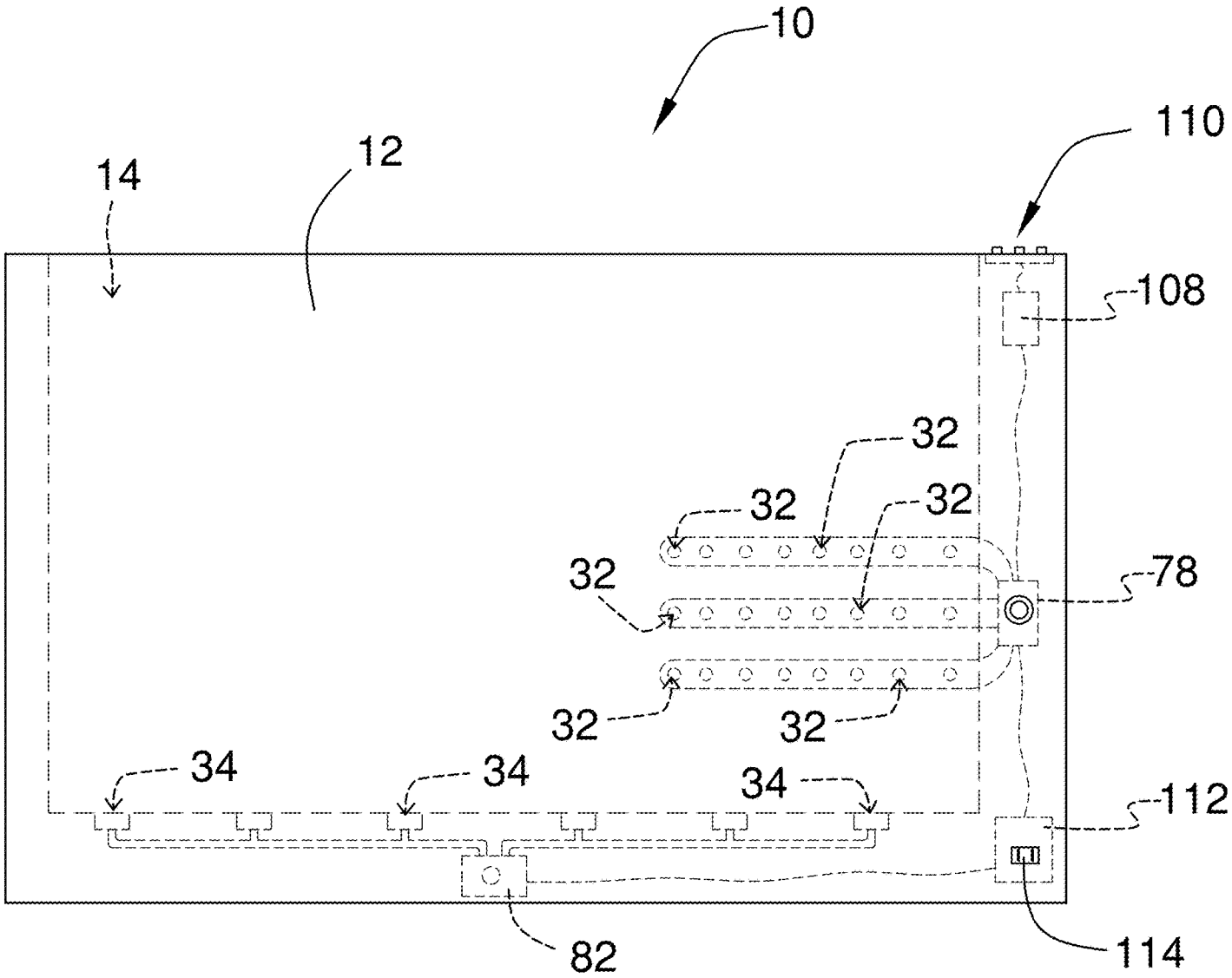
FIG. 4 is a rear view of an embodiment of the disclosure.
Figure 5:
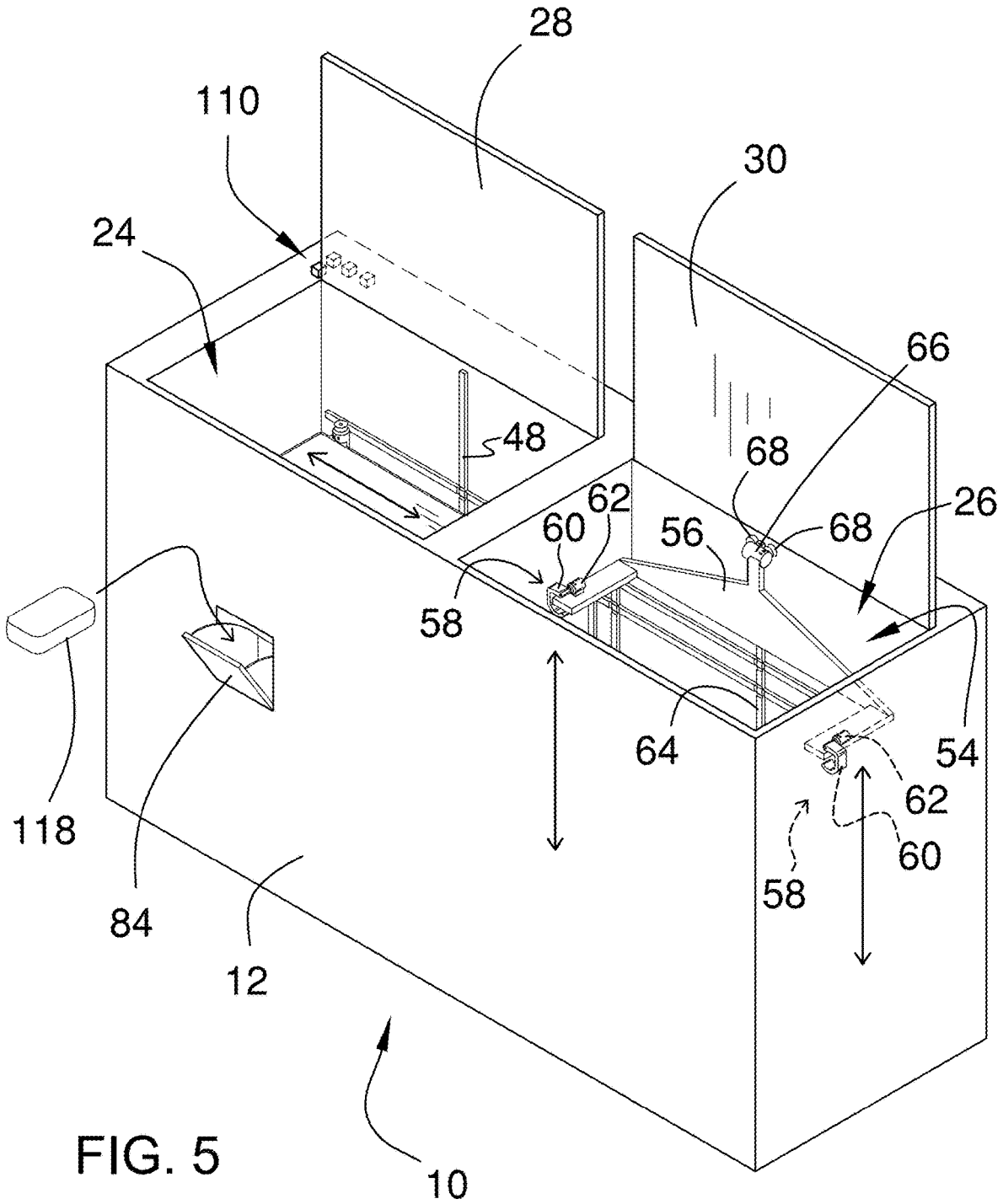
FIG. 5 is a perspective view of an embodiment of the disclosure.
Figure 6:
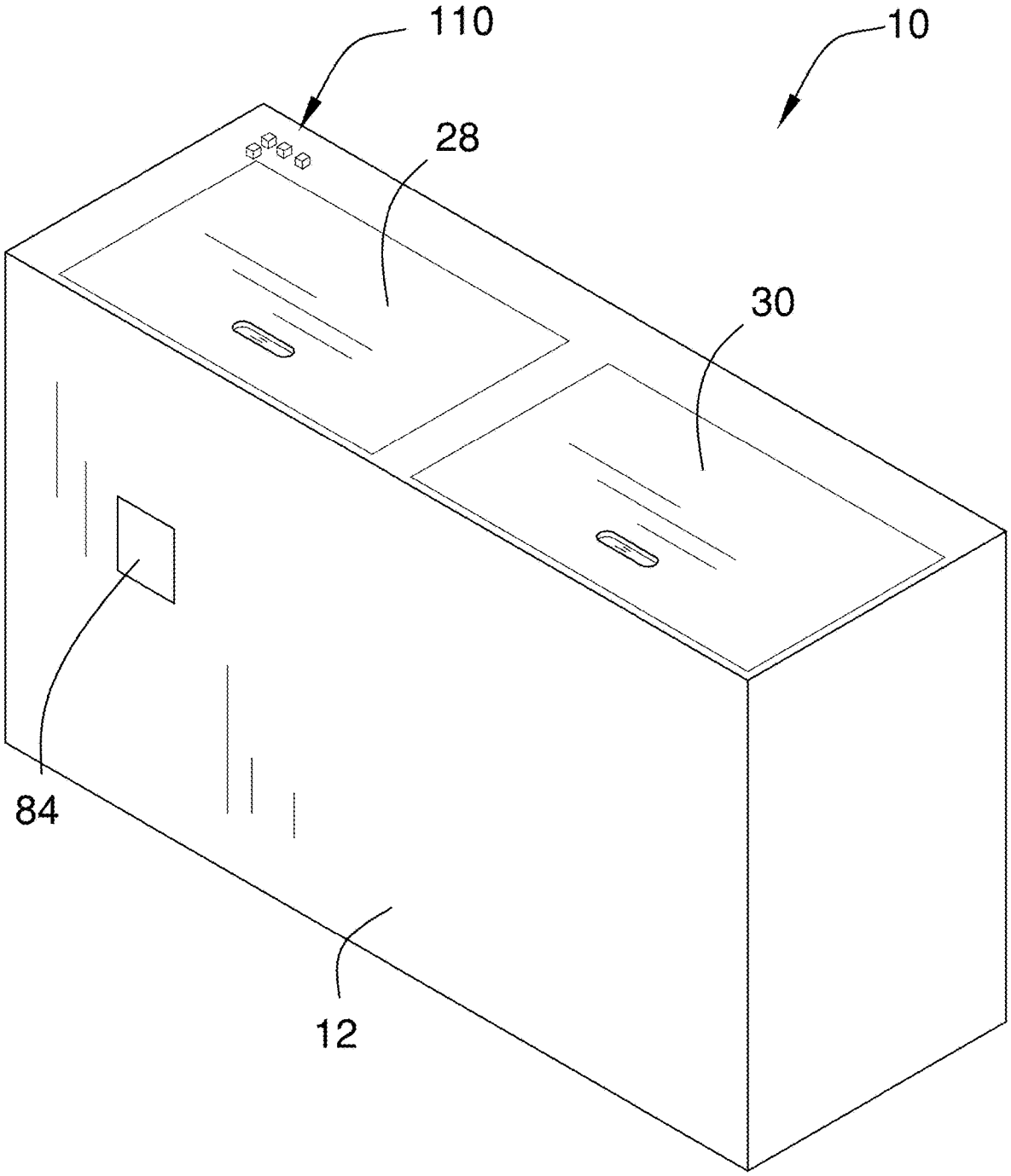
FIG. 6 is a perspective view of an embodiment of the disclosure.
Figure 7:
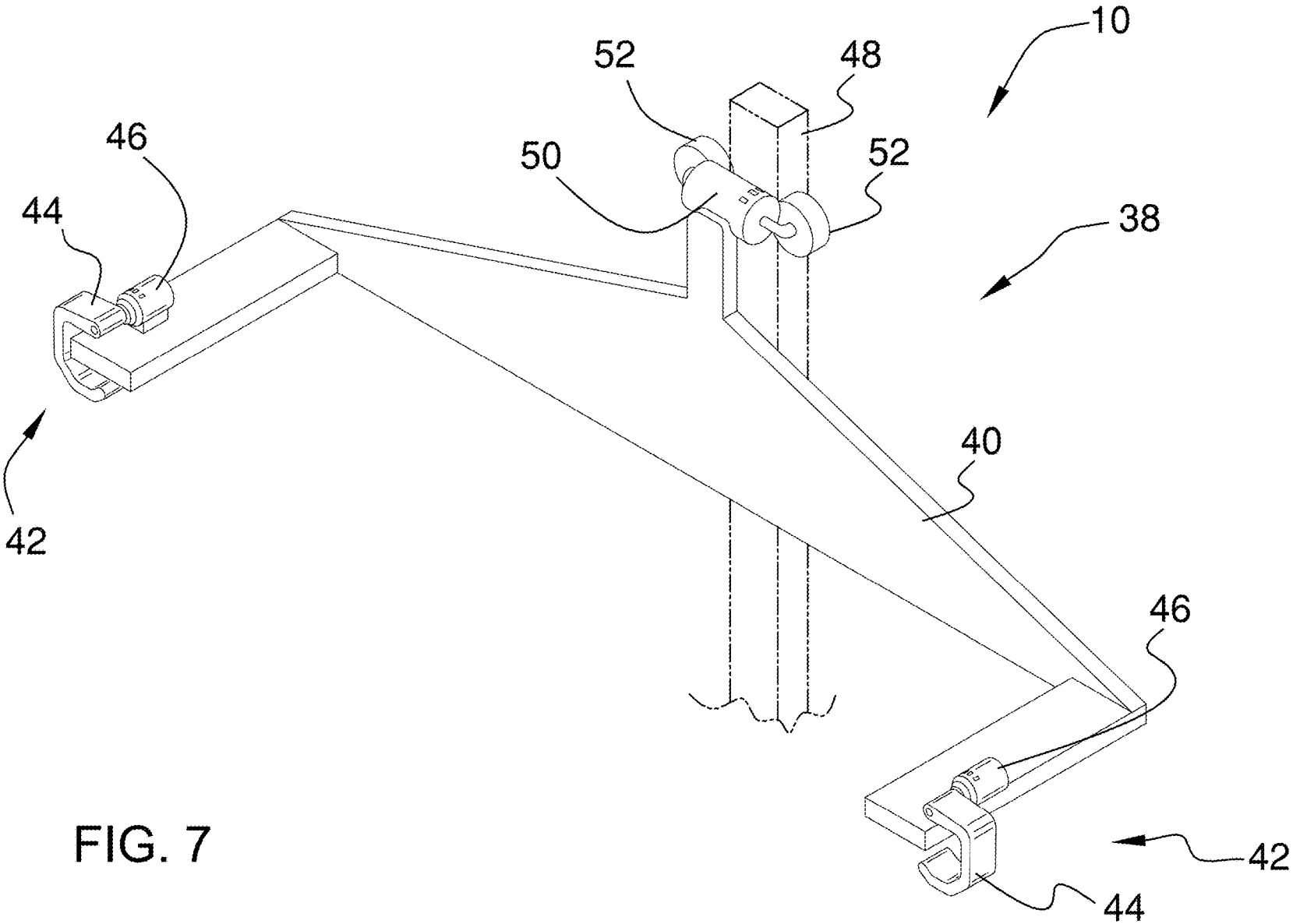
FIG. 7 is a detail view of a lift of an embodiment of the disclosure.
Figure 8:
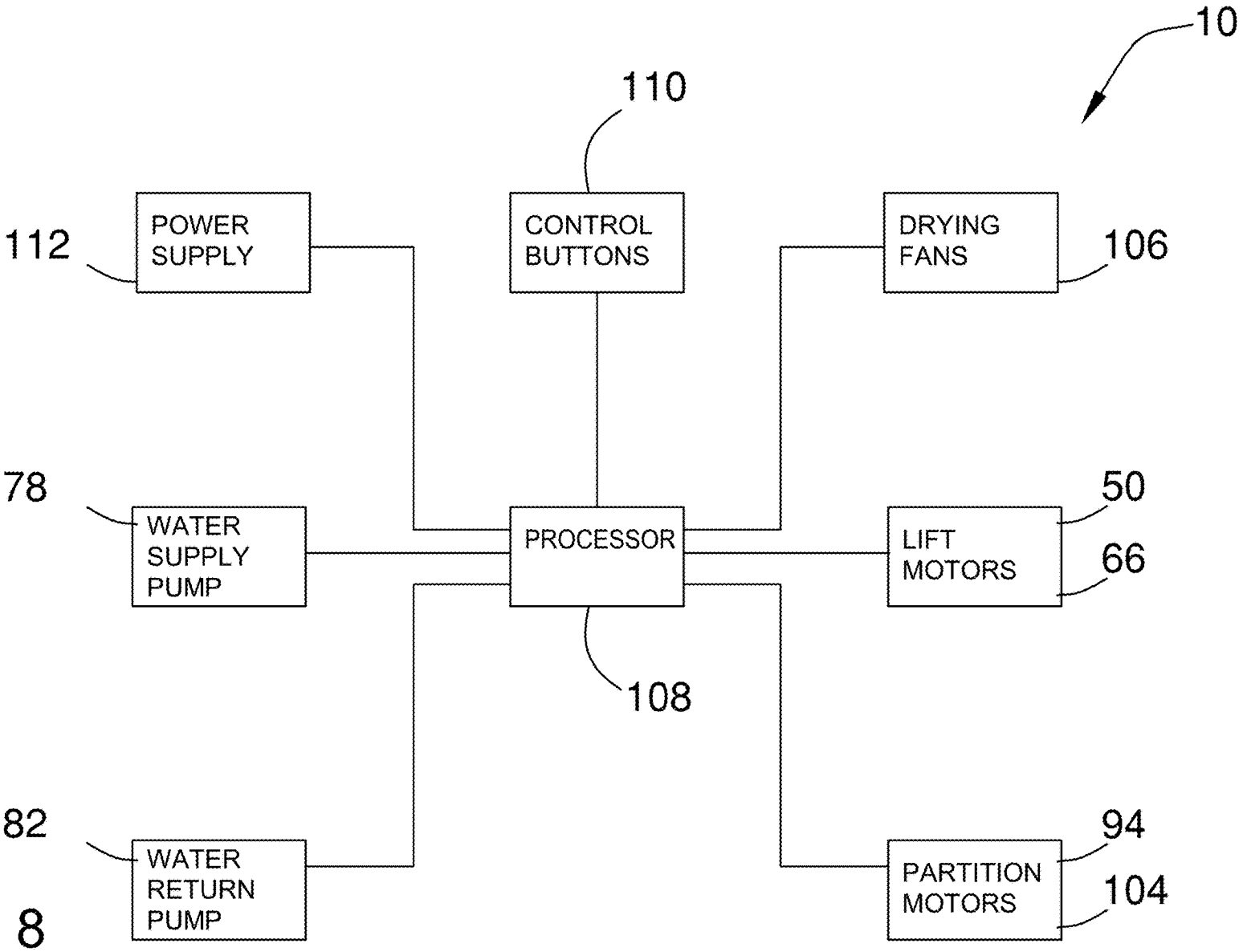
FIG. 8 is a block diagram of an embodiment of the disclosure.

With reference now to the drawings, and in particular to FIGS. 1 through 8 thereof, a new dish washer embodying the principles and concepts of an embodiment of the disclosure and generally designated by the reference numeral 10 will be described.

As best illustrated in FIGS. 1 through 8, the dish cleaning system 10 generally comprises a cabinet 12 which defines an interior volume 14 therein. The interior volume 14 includes a loading space 16, a washing space 18, a drying space 20, and a storage space 22. The washing space 18 is positioned between the loading space 16 and a bottom side of the cabinet 12. The drying space 20 is positioned laterally adjacent to the washing space 18, and the storage space 22 is positioned between the washing space 18 and a top side of the cabinet 12. The cabinet 12 defines a loading opening 24 which extends into the cabinet 12 to the loading space 16 and a storage opening 26 which extends into the cabinet 12 to the storage space 22. A loading door 28 is movable to alternately open and close with respect to the loading opening 24, and a storage door 30 is movable to alternately open and close with respect to the storage opening 26.

A dish rack 36 is positionable in the cabinet 12 and is configured to hold dishes 116. The dish rack 36 may have a wireframe structure or any suitable shape for holding dishes 116. The dish rack 36 is movable through the interior volume 14 via a drive system mounted in the cabinet 12 so that the dishes 116 may be moved through each of the loading space 16, the washing space 18, the drying space 20, and the storage space 22.

The drive system comprises a loading lift 38 which moves the dish rack 36 between the loading space 16 and the washing space 18, a conveyor device 70 which moves the dish rack 36 between the washing space 18 and the drying space 20, and a storage lift 54 which moves the dish rack 36 between the drying space 20 and the storage space 22. In other embodiments the drive system may have other suitable mechanisms for moving the dish rack 36 throughout the interior volume 14 of the cabinet 12, such as a robotic arm, a single carriage mounted to a track that travels through each of the spaces 16, 18, 20, 22, a hydraulic lift, or the like.

The loading lift 38 includes a loading carriage 40 mounted in the cabinet 12 which is movable between the loading space 16 and the washing space 18. A loading rack connector 42 is mounted to the loading carriage 40 and is operable to connect the dish rack 36 to the loading carriage 40. The loading rack connector 42 comprises a pair of loading hooks 44 and a pair of loading hook actuators 46. The loading hook actuators 46 are operable to interlock the loading hooks 44 with a rim of the dish rack 36, thereby supporting the dish rack 36. A loading rail 48 is mounted in the cabinet 12 and extends between and into the loading space 16 and the washing space 18. A loading motor 50 operates loading wheels 52 that are rotatable mounted to the loading carriage 40 and movably mounted to the loading rail 48. The loading wheels 52 may secure the loading carriage 40 at various heights with respect to the loading rail 48 by clamping onto the loading rail 48. In other embodiments, the loading wheels 52 may have teeth which mesh with teeth of the loading rail 48.

The storage lift 54 is substantially similar in structure to the loading lift 38. The storage lift 54 includes a storage carriage 56 mounted in the cabinet 12 which is movable between the storage space 22 and the washing space 18. A storage rack connector 58 is mounted to the storage carriage 56 and is operable to connect the dish rack 36 to the storage carriage 56. The storage rack connector 58 comprises a pair of storage hooks 60 and a pair of storage hook actuators 62. The storage hook actuators 62 are operable to interlock the storage hooks 60 with a rim of the dish rack 36, thereby supporting the dish rack 36. A storage rail 64 is mounted in the cabinet 12 and extends between and into the storage space 22 and the washing space 18. A storage motor 66 operates storage wheels 68 that are rotatable mounted to the storage carriage 56 and movably mounted to the storage rail 64. The storage wheels 68 may secure the storage carriage 56 at various heights with respect to the storage rail 64 by clamping onto the storage rail 64. In other embodiments, the storage wheels 68 may have teeth which mesh with teeth of the storage rail 64.

The conveyor device 70 comprises a belt 72 for supporting the dish rack 36 and a conveyor motor 74 operably coupled to the belt 72. The conveyor device 70 extends between and into the washing space 18 and the drying space 20.

A washing assembly is included in the washing space 18 of the interior volume 14 of the cabinet 12 to wash the dishes 116. The washing assembly comprises a water supply line 76, a water supply pump 78, a water return line 80, and a water return pump 82. The water supply pump 78 is in fluid communication with the water supply line 76 and is operable to urge fluid from a water source via the water supply line 76 through ports 32 in the cabinet 12 into the washing space 18 of the interior volume 14 of the cabinet 12. Drains 34 at a bottom of the interior volume 14 are in fluid communication with the interior volume 14 and lead to the water return line 80. The water return pump 82 is operable to urge fluid from the interior volume 14 away from the cabinet 12. The water return line 80 may be attached to a home plumbing system or other suitable drainage structure. A detergent door 84 is positioned on a front of the cabinet 12 which contains a cavity for holding detergent 118. Various other detergent holding means may be used throughout the interior volume 14 of the cabinet 12. In some embodiments, a tank may be configured to hold a quantity of detergent 118 which is urged into the washing space 18 of the interior volume 14 via a detergent pump or other suitable dispensing mechanism.

A horizontal partition 86 and a vertical partition are mounted in the cabinet 12 and may be positioned to enclose the dish rack 36 in the washing space 18 and moved away from such positions to allow movement of the dish rack 36 into or out of the washing space 18. The horizontal partition 86 is movable between a first position and a second position. The first position of the horizontal partition 86 is between the loading space 16 and the washing space 18, and the second position of the horizontal partition 86 is between the storage space 22 and the drying space 20. The horizontal partition 86 moves along a pair of horizontal rails 92 that are positioned opposite each other across the interior volume 14. A horizontal partition drive 94 including a motor and wheels is operable to move the horizontal partition 86 on the horizontal rails 92 between the first and second positions, of the horizontal partition 86.

The vertical partition 96 is movable between a first position and a second position. The first position of the vertical partition 96 is between the loading space 16 and the washing space 18, and the second position of the vertical partition 96 is between the storage space 22 and the drying space 20. The vertical partition 96 moves along a pair of vertical rails 102 that are positioned opposite each other across the interior volume 14. A vertical partition drive 104 including a motor and wheels is operable to move the vertical partition 96 on the vertical rails 102 between the first and second positions, of the vertical partition 96.

A pair of fans 106 is mounted in the cabinet 12 adjacent to the drying space 20. The fans 106 are positioned and configured to circulate air in the drying space 20 when activated.

A processor 108 is provided which is in operative communication with the drive system, the washing assembly, the horizontal partition drive 94 and the vertical partition drive 104. The processor 108 may have instructions for washing dishes 116 in one or more cycle types. A control interface 110 is mounted to an exterior of the cabinet 12 to direct the processor 108 to operate to move, wash, and dry the dishes 116 in the dish rack 36. A power supply 112 is electrically coupled to the processor 108. The power supply 112 comprises a battery but may comprise a capacitor or other suitable energy storage means. A power cord 114 is electrically coupled to the power supply 112 and is configured to electrically couple to an external power source. In other embodiments, the power cord 114 may be directly connected to the processor 108.

In use, dishes 116 may be placed in the dish rack 36, washed by the dish cleaning system 10 as directed by the processor 108, and stored. Generally, the dishes 116 are placed in the dish rack 36 when the dish rack 36 is held by the loading lift 38 in the loading space 16. The processor 108 is directed by the control interface 110 or other suitable means to move the dish rack 36 with the dishes 116 into the washing space 18 via the loading lift 38. The processor 108 directs the horizontal and vertical partition 96*s* to move in order to either make way for the dish rack 36 or enclose the dish rack 36 in the washing space 18. After the processor 108 causes the washing assembly to wash the dishes 116, the conveyor device 70 is activated by the processor 108 to move the dish rack 36 to the drying space 20. The dish rack 36 is allowed to remain in the drying space 20 for a period of time to dry the dishes 116, and the processor 108 activates the fans 106 to accelerate drying. Finally, the dish rack 36 is brought up to the storage space 22 via the storage lift 54. Dishes 116 may be kept in the storage space 22 until needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dish cleaning system comprising:

a cabinet defining an interior volume therein, the interior volume including a loading space, a washing space, a drying space, and a storage space;

a dish rack positionable in the cabinet and configured to hold a plurality of dishes;

a drive system mounted in the cabinet and configured to move the dish rack between the loading space, the washing space, the drying space, and the storage space, the drive system including:

a loading lift configured to move the dish rack between the loading space and the washing space;

a conveyor device configured to move the dish rack between the washing space and the drying space; and a storage lift configured to move the dish rack between the drying space and the storage space; and a washing assembly configured to wash contents of the washing space of the interior volume of the cabinet.

2. The system of claim 1, wherein the loading lift comprises:

a loading carriage mounted in the cabinet, the loading carriage being movable between the loading space and the washing space; and a loading rack connector configured to selectively connect the dish rack to the loading carriage.

3. The system of claim 2, wherein the loading rack connector of the loading lift comprises a pair of loading hooks and a pair of loading hook actuators, the loading hook actuators being operable to interlock the loading hooks with a rim of the dish rack.

4. The system of claim 2, wherein the loading lift further comprises:

a loading rail mounted in the cabinet, the loading rail extending between and into the loading space and the washing space;

a pair of loading wheels rotatably mounted to the loading carriage, the loading wheels movably mounting the loading carriage to the loading rail; and a loading motor operably coupled to the pair of loading wheels.

5. The system of claim 1, wherein the conveyor device comprises a belt for supporting the dish rack and a conveyor motor operably coupled to the belt, the conveyor device extending between and into the washing space and the drying space.

6. The system of claim 1, wherein the storage lift comprises:

a storage carriage mounted in the cabinet, the storage carriage being movable between the drying space and the storage space; and a storage rack connector configured to selectively connect the dish rack to the storage carriage.

7. The system of claim 6, wherein the storage rack connector of the storage lift comprises a pair of storage hooks and a pair of storage hook actuators, the storage hook actuators being operable to interlock the storage hooks with a rim of the dish rack.

8. The system of claim 6, wherein the storage lift further comprises:

a storage rail mounted in the cabinet, the storage rail extending between and into the drying space and the storage space;

a pair of storage wheels rotatably mounted to the storage carriage, the storage wheels movably mounting the storage carriage to the storage rail; and a storage motor operably coupled to the pair of storage wheels.

9. The system of claim 1 wherein the washing assembly comprises:

a water supply line extending into the cabinet, the cabinet defining a port on an interior surface of the cabinet, the port being in fluid communication with the water supply line and the washing space;

a water supply pump in fluid communication with the water supply line, the water supply pump being configured to urge fluid from the water supply line and into the washing space through the port; and a water return extending into the cabinet, the cabinet defining a drain therein at a bottom of the interior volume, the drain being in fluid communication with a water return line and the interior volume.

10. The system of claim 9, wherein the washing assembly further comprises a water return pump and fluid communication with the water return line, the water return pump being configured to urge fluid from the interior volume into the water return line through the drain.

11. The system of claim 1, further comprising:

a horizontal partition movably mounted in the cabinet, the horizontal partition being movable between a first position and a second position, the first position of the horizontal partition being between the loading space and the washing space, the second position of the horizontal partition being between the storage space and the drying space; and a vertical partition movably mounted in the cabinet, the vertical partition being movable between a first position and a second position, the first position of the vertical partition being between the loading space and the storage space, the second position of the vertical partition being between the washing space and the drying space.

12. The system of claim 11, further comprising:

a horizontal rail mounted in the cabinet, the horizontal partition being movably mounted on the horizontal rail; and a horizontal partition drive configured to move the horizontal partition on the horizontal rail between the first and second positions of the horizontal partition.

13. The system of claim 11, further comprising:

a vertical rail mounted in the cabinet, the vertical partition being movably mounted on the vertical rail; and a vertical partition drive configured to move the vertical partition on the vertical rail between the first and second positions of the vertical partition.

14. The system of claim 1, further comprising a fan mounted in the cabinet adjacent to the drying space, the fan being positioned and configured to circulate air in the drying space when activated.

15. The system of claim 1, wherein the cabinet defines a loading opening which extends into the cabinet to the loading space, the cabinet defining a storage opening which extends into the cabinet to the storage space, the cabinet including a loading door which is movable to alternately open and close with respect to the loading opening, the cabinet including a storage door which is movable to alternately open and close with respect to the storage opening.

16. A dish cleaning system comprising:

a cabinet defining an interior volume therein, the interior volume including a loading space, a washing space, a drying space, and a storage space, the cabinet defining a loading opening which extends into the cabinet to the loading space, the cabinet defining a storage opening which extends into the cabinet to the storage space, the washing space being positioned between the loading space and a bottom side of the cabinet, the drying space being positioned laterally adjacent to the washing space, the storage space being positioned between the washing space and a top side of the cabinet, the cabinet including a loading door which is movable to alternately open and close with respect to the loading opening, the cabinet including a storage door which is movable to alternately open and close with respect to the storage opening;

a dish rack positionable in the cabinet and configured to hold a plurality of dishes;

a drive system mounted in the cabinet and configured to move the dish rack between the loading space, the washing space, the drying space, and the storage space, the drive system comprising:

a loading lift configured to move the dish rack between the loading space and the washing space, the loading lift comprising:

a loading carriage mounted in the cabinet, the loading carriage being movable between the loading space and the washing space;

a loading rack connector configured to selectively connect the dish rack to the loading carriage, the loading rack connector comprising a pair of loading hooks and a pair of loading hook actuators, the loading hook actuators being operable to interlock the loading hooks with a rim of the dish rack;

a loading rail mounted in the cabinet, the loading rail extending between and into the loading space and the washing space;

a pair of loading wheels rotatably mounted to the loading carriage, the loading wheels movably mounting the loading carriage to the loading rail; and a loading motor operably coupled to the pair of loading wheels;

a conveyor device configured to move the dish rack between the washing space and the drying space, the conveyor device comprising a belt for supporting the dish rack and a conveyor motor operably coupled to the belt, the conveyor device extending between and into the washing space and the drying space; and a storage lift configured to move the dish rack between the drying space and the storage space, the storage lift comprising:

a storage carriage mounted in the cabinet, the storage carriage being movable between the drying space and the storage space;

a storage rack connector configured to selectively connect the dish rack to the storage carriage, the storage rack connector comprising a pair of storage hooks and a pair of storage hook actuators, the storage hook actuators being operable to interlock the storage hooks with the rim of the dish rack;

a storage rail mounted in the cabinet, the storage rail extending between and into the drying space and the storage space;

a pair of storage wheels rotatably mounted to the storage carriage, the storage wheels movably mounting the storage carriage to the storage rail; and a storage motor operably coupled to the pair of storage wheels;

a washing assembly configured to wash contents of the washing space of the interior volume of the cabinet, the washing assembly comprising:

a water supply line extending into the cabinet, the cabinet defining a plurality of ports on an interior surface of the cabinet, the plurality of ports being in fluid communication with the water supply line and the washing space;

a water supply pump in fluid communication with the water supply line, the water supply pump being configured to urge fluid from the water supply line and into the washing space through the plurality of ports;

a water return line extending into the cabinet, the cabinet defining a plurality of drains therein at a bottom of the interior volume, the plurality of drains being in fluid communication with the water return line and the interior volume; and a water return pump in fluid communication with the water return line, the water return pump being configured to urge fluid from the interior volume into the water return line through the plurality of drains;

a horizontal partition movably mounted in the cabinet, the horizontal partition being movable between a first position and a second position, the first position of the horizontal partition being between the loading space and the washing space, the second position of the horizontal partition being between the storage space and the drying space;

a pair of horizontal rails mounted in the cabinet, the horizontal rails being positioned opposite each other across the interior volume, the horizontal partition being movably mounted on the pair of horizontal rails;

a horizontal partition drive configured to move the horizontal partition on the horizontal rails between the first and second positions of the horizontal partition;

a vertical partition movably mounted in the cabinet, the vertical partition being movable between a first position and a second position, the first position of the vertical partition being between the loading space and the storage space, the second position of the vertical partition being between the washing space and the drying space;

a pair of vertical rails mounted in the cabinet, the vertical rails being positioned opposite each other across the interior volume, the vertical partition being movably mounted on the pair of vertical rails;

a vertical partition drive configured to move the vertical partition on the vertical rails between the first and second positions of the vertical partition; and a fan mounted in the cabinet adjacent to the drying space, the fan being positioned and configured to circulate air in the drying space when activated.

* * * * *